US007164090B2

(12) United States Patent
Beerling

(10) Patent No.: US 7,164,090 B2
(45) Date of Patent: Jan. 16, 2007

(54) LIQUID METAL SWITCH EMPLOYING A SINGLE VOLUME OF LIQUID METAL

(75) Inventor: Timothy Beerling, San Francisco, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 25 days.

(21) Appl. No.: 11/068,633

(22) Filed: Feb. 28, 2005

(65) Prior Publication Data

US 2006/0191778 A1 Aug. 31, 2006

(51) Int. Cl.
*H01H 29/00* (2006.01)

(52) U.S. Cl. ..... 200/182; 200/191; 200/228

(58) Field of Classification Search ..... 200/182, 200/187–189, 191–194, 199, 228–232
See application file for complete search history.

(56) References Cited

U.S. PATENT DOCUMENTS

| | | | | |
|---|---|---|---|---|
| 6,559,420 | B1 | 5/2003 | Zarev | |
| 6,717,495 | B1 * | 4/2004 | Kondoh et al. | 335/47 |
| 6,743,991 | B1 * | 6/2004 | Wong et al. | 200/182 |
| 6,756,552 | B1 * | 6/2004 | Takenaka et al. | 200/224 |
| 6,822,175 | B1 * | 11/2004 | Kondoh et al. | 200/182 |
| 6,946,776 | B1 * | 9/2005 | Fong et al. | 310/328 |

* cited by examiner

*Primary Examiner*—Richard K. Lee

(57) ABSTRACT

A switch comprises an input contact and at least one output contact, a single droplet of conductive liquid located in a channel, the droplet being in constant contact with the input contact, and a heater configured to heat a gas. The heated gas expands to cause the droplet to translate through the channel.

16 Claims, 3 Drawing Sheets

LIQUID METAL SWITCH EMPLOYING A SINGLE VOLUME OF LIQUID METAL

BACKGROUND OF THE INVENTION

Many different technologies have been developed for fabricating switches and relays for low frequency and high frequency switching applications. Many of these technologies rely on solid, mechanical contacts that are alternatively actuated from one position to another to make and break electrical contact. Unfortunately, mechanical switches that rely on solid-solid contact are prone to wear and are subject to a condition referred to as "fretting." Fretting refers to erosion that occurs at the points of contact on surfaces.

To minimize mechanical damage imparted to switch and relay contacts, switches and relays have been fabricated using liquid metals to wet the movable mechanical structures to prevent solid to solid contact. It is also possible to move a volume a liquid metal, creating a switch without any solid moving parts.

A liquid metal microswitch is described in U.S. Pat. No. 6,559,420, assigned to the assignee of the present application, and hereby incorporaed by reference. The liquid metal microswitch in U.S. Pat. No. 6,559,420 uses gas pressure to divide one of two liquid metal switching elements to provide the switching function. For a SPDT (single pole, double throw) switch, one of the two liquid metal elements is always in contact with the input electrode and with one output electrode, and one liquid metal element is always in contact with the other output electrode (the isolated output electrode, also referred to as the isolated port). The application of pressure to the liquid metal that connects the input electrode to one of the output electrodes will toggle the switch to the other state, providing SPDT action. Unfortunately, using two elements of liquid metal causes the microswitch to be susceptible to capacitive coupling into the isolated port. Further, dividing one of the liquid metal elements of the microswitch frequently causes fragmentation of the liquid metal element through the formation of one or more microdroplets, also referred to as "satellites." Microdroplets frequently form when one of the liquid metal elements is divided by the gas pressure. The microdroplets may enter the gas conduit through which actuating pressure is directed, clogging the conduit channel and reducing the amount of liquid metal available for switching.

SUMMARY OF THE INVENTION

In accordance with the invention a switch includes an input contact, at least one output contact, and a single droplet of conductive liquid located in a channel. The single droplet is in constant contact with the input contact. The switch also typically includes a heater configured to heat a gas. The heated gas expands causing the droplet to translate through the channel.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The embodiments in accordance with the invention described below can be used in any application where it is desirable to provide fast, reliable switching. While described below as switching a radio frequency (RF) signal, the architecture can be used for other switching applications, such as low frequency switching.

Figure 1A:
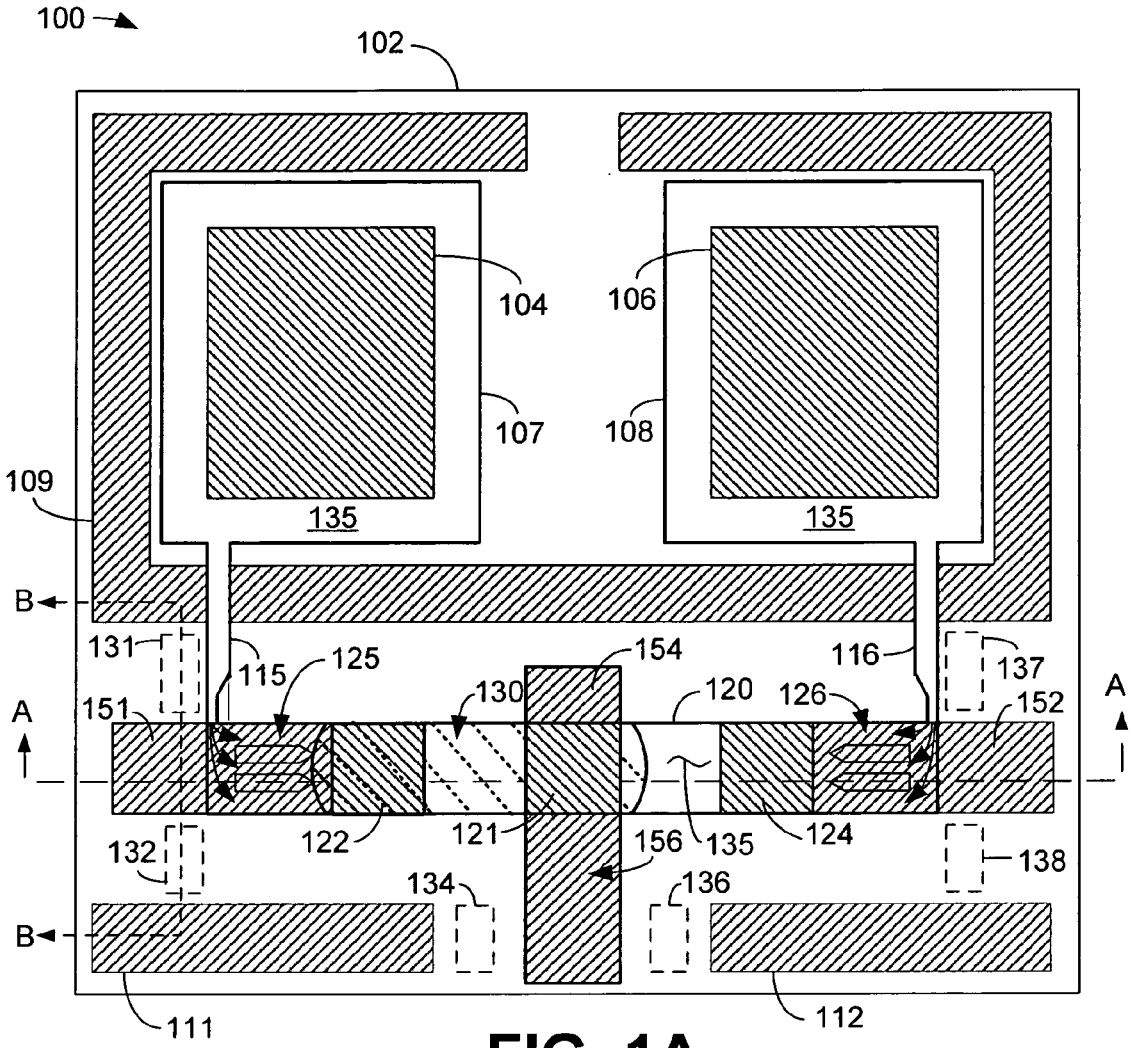
FIG. 1A is a schematic diagram illustrating a micro circuit for a SPDT switch.

FIG. 1A is a schematic diagram illustrating a micro circuit 100. In this example, the micro circuit 100 can be a liquid metal micro-switch. The liquid metal micro-switch 100 is fabricated on a substrate 102 that may include one or more layers (not shown). For example, the substrate 102 can be partially covered with a dielectric material (not shown) and other material layers. The liquid metal micro-switch 100 can be a fabricated structure using, for example, thin film deposition techniques and/or thick film screening techniques which could comprise either single layer or multi-layer circuit substrates.

The liquid metal micro-switch 100 includes heaters 104 and 106. The heater 104 resides within a cavity 107 and the heater 106 resides within a cavity 108. The liquid metal micro-switch 100 also includes a cover, or cap, which is omitted from FIG. 1A The cavities 107 and 108 can be filled with a gas, which can be, for example, nitrogen ($N_2$) and which is illustrated using reference numeral 135. The cavity 107 is coupled via a sub-channel 115 to a main channel 120. Similarly, the cavity 108 is coupled via sub-channel 116 to the main channel 120. The main channel 120 is partially filled with a single droplet 130 of liquid metal. The droplet 130 is sometimes referred to as a "slug." The liquid metal, which is typically mercury, gallium alloy, or another liquid metal, is in constant contact with an input contact 121 and one of two output contacts 122 and 124.

In this exemplary embodiment in accordance with the invention, a portion 151 of metallic material underlying the contact 122 extends past the periphery of the main channel 120 onto the substrate 102. Similarly, a portion 152 of metallic material underlying the output contact 124 extends past the periphery of the main channel 120 onto the substrate 102, and portions 154 and 156 of the metallic material underlying the input contact 121 extend past the periphery of the main channel 120 onto the substrate 102. The metal portions 151, 152, 154 and 156 are generally covered by a dielectric, which is omitted from FIG. 1A for simplicity of illustration. Metallic material is also deposited, or otherwise applied to the substrate 102 approximately in regions 109, 111 and 112 to provide metal bonding capability to attach a cap, if desired. The cap, also referred to as a cover that defines walls and a roof, will be described below. Bonding the roof to the switch 100 may also be accomplished by anodic bonding, in which case the regions 109, 111 and 112 would include a layer of amorphous silicon. The output contacts 122 and 124 are preferably fabricated as small as possible to minimize the amount of energy used to separate the droplet 130 from the output contact 122 or from the output contact 124 when switching is desired. Further, minimizing the area of the contacts 121, 122 and 124 further improves electrical isolation among the contacts by minimizing the likelihood of capacitive coupling between the droplet 130 and the contact with which the droplet is not in physical contact.

The main channel 120 includes a feature 125 and a feature 126 as shown. The features 125 and 126 can be fabricated on the surface of the substrate 102 as, for example, islands that extend upward from the base of the main channel 120 and that contact the edge of the liquid metal droplet 130 as shown. These features 125 and 126 may also be defined as part of the cover that defines the sidewalls and roof of the channel 120. The features 125 and 126 determine the at-rest position of the liquid metal droplet 130. To effect movement of the liquid metal droplet 130 and therefore perform a switching function, one of the heaters 104 or 106 heats the gas 135 in the cavity 107 or 108 causing the gas 135 to expand and travel through one of the sub-channels 115 or 116. The expanding gas 135 exerts pressure on the droplet 130, causing the droplet 130 to translate through the main channel 120. When the position of the droplet 130 is as shown in FIG. 1A, the heater 104 heats the gas 135 in the cavity 107, thus expanding and forcing the gas through the sub-channel 115 and around the feature 125 so that a relatively constant wall of pressure is exerted against the droplet 130. The gas pressure thus exerted causes the droplet to move towards the output contact 124. As will be described in greater detail below, the feature 125 and the feature 126 prevent the droplet 130 from extending past a definable point in the main channel 120, but allow the droplet 130 to easily de-wet from the features 125 and 126 when movement of the droplet 130 is desired.

Further, because a single droplet 130 is used in the micro-switch 100, the likelihood that the droplet 130 will fragment into microdroplets that may enter the sub-channels 115 and 116 is significantly reduced when compared to a switch in which the liquid metal droplet is divided into multiple segments to provide the switching action.

Although omitted for clarity in FIG. 1A, the main channel 120 also includes one or more vents that are used to load the liquid metal into the main channel 120. The vents can be sealed after the introduction of the liquid metal.

The main channel also includes one or more defined areas that include surfaces that can alter and define the contact angle between the droplet 130 and the main channel 120. A contact angle, also referred to as a wetting angle, is formed where the droplet 130 meets the surface of the main channel 120. The contact angle is measured at the point at which the surface, liquid and gas meet. The gas can be, in this example, nitrogen, or another gas that forms the atmosphere surrounding the droplet 130. A high contact angle is formed when the droplet 130 contacts a surface that is referred to as relatively non-wetting, or less wettable. The wettability is generally a function of the material of the surface and the material from which the droplet 130 is formed, and is specifically related to the surface tension of the liquid.

Portions of the main channel 120 can be defined to be wetting, non-wetting, or to have an intermediate contact angle. For example, it may be desirable to make the portions of the main channel 120 that extends past the output contacts 122 and 124 to be less, or non-wetting to prevent the droplet 130 from entering these areas. Similarly, the portion of the main channel in the vicinity of the features 125 and 126 may be defined to create an intermediate contact angle between the droplet 130 and the main channel 120. This will be described below.

The liquid metal micro-switch 100 also includes one or more gaskets, as shown using reference numerals 131, 132, 134, 136, 137 and 138. The gaskets will be described in greater detail below.

Figure 1B:
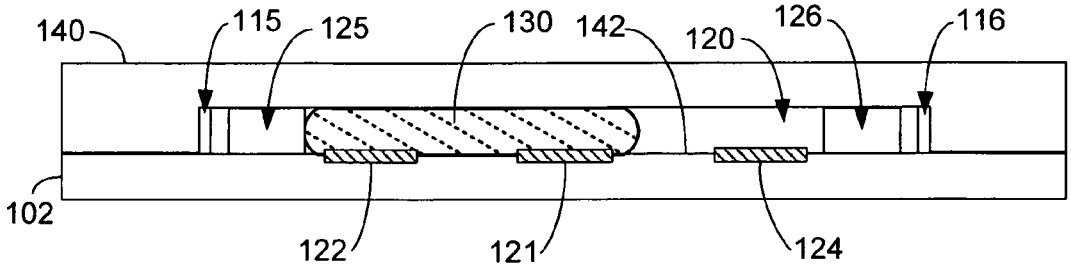
FIG. 1B is a simplified cross-sectional view through section A—A of FIG. 1A.

FIG. 1B is a simplified cross-sectional view through section A—A of FIG. 1A. The substrate 102 supports the liquid metal droplet 130 approximately as shown. The droplet 130 is in contact with the input contact 121 and the output contact 122, and rests against the feature 125. When gas pressure is exerted through the sub-channel 115, the gas 135 passes around and through portions of the feature 125, exerting pressure on the droplet 130 and causing the droplet 130 to move toward the output contact 124. In accordance with another aspect of the invention, and which will be described in greater detail below, portions of the surface 142 of the substrate 102 include a material or surface treatment designed to produce an intermediate contact angle between the droplet 130 and the surface 142. An area of intermediate wettability forms an intermediate contact angle under the droplet and in the vicinity of, but not in contact with the input contact 121 and the output contacts 122 and 124. In general, the contact angle between a conductive liquid and a surface with which it is in contact ranges between 0° and 180° and is dependent upon the material from which the droplet is formed, the material of the surface with which the droplet is in contact, and is specifically related to the surface tension of the liquid. A high contact angle is formed when the droplet contacts a surface that is referred to as relatively non-wetting, or less wettable. A more wettable surface corresponds to a lower contact angle than a less wettable surface. An intermediate contact angle is one that can be defined by selection of the material covering the surface on which the droplet is in contact and is generally an angle between the high contact angle and the low contact angle corresponding to the non-wetting and wetting surfaces, respectively. If the gas pressure exerted against the droplet causes the droplet 130 to overshoot the desired position, the intermediate contact angle helps cause the droplet 130 to return to the desired position in the vicinity of, and in contact with, the output contact 122 or 124. The liquid metal micro-switch 100 also includes a cap 140, thus encapsulating the droplet 130.

Figure 2A:
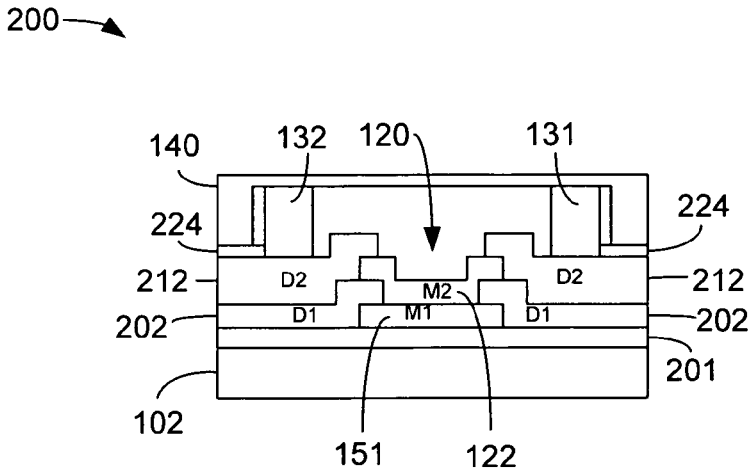
FIG. 2A is a schematic diagram illustrating a cross-section of a portion of the liquid metal micro-switch taken through section B—B of FIG. 1A.

FIG. 2A is a schematic diagram 200 illustrating a cross-section of a portion of the liquid metal micro-switch 100 taken through section B—B of FIG. 1A. An isolating dielectric layer 201 of, for example, silicon dioxide ($SiO_2$) or silicon nitride (SiN) is applied over the surface of the substrate 102. Portions of the substrate 102 include a first metal layer 151 and a first selectively applied layer of dielectric 202 formed thereon. A second metal layer is formed over the first metal layer 151 and forms the portion of the output contact 122 that contacts the droplet 130. The first selective dielectric layer 202 can be formed using, for example, $SiO_2$ or SiN. A second selectively applied dielectric layer 212 is formed over the first selective dielectric layer 202 and a portion of the second metal layer 122. The second selective dielectric can be formed using, for example, SiO2 or tantalum pentoxide ($Ta_2O_5$). A layer of amorphous silicon is applied over the second selective dielectric layer 212 in the regions 111 and 109 to allow the cap 140 to be anodically bonded to the substrate 102. Other methods of attaching the cap 140 are also possible and would influence the choice of material in the regions 109 and 111. In accordance with this aspect of the invention, gasket portions 131 and 132 seal the main channel 120 against the cap 140. The material from which the gasket portions 131 and 132 are formed can be a photo-definable polymer, such as, for example, polyimide. The gasket material eliminates leak paths for the pressurized gas, ensuring proper switch operation.

Figure 2B:
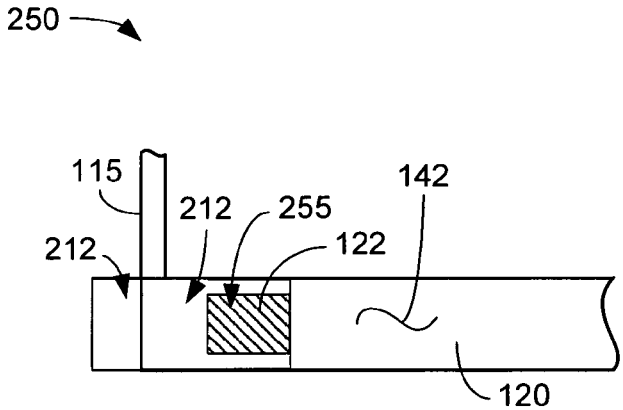
FIG. 2B is a schematic diagram illustrating a plan view of a portion of the main channel 120.

FIG. 2B is a schematic diagram 250 illustrating a plan view of a portion of the main channel 120. Portions of the surface 142 of the base of the main channel 120 are covered with the first metal layer 151, the second selective dielectric 212 and the second metal layer, which forms the output contact 122. The output contact 122 is fabricated from a metal material that is designed to contact the droplet 130 (not shown). The metal material of the output contact 122 is in electrical contact with the metal material of the first metal layer 151 (FIG. 1A). An opening 255 is created in the second selective dielectric layer 212 to expose the portion of the second metal layer that will be the output contact 122.

Figure 3:
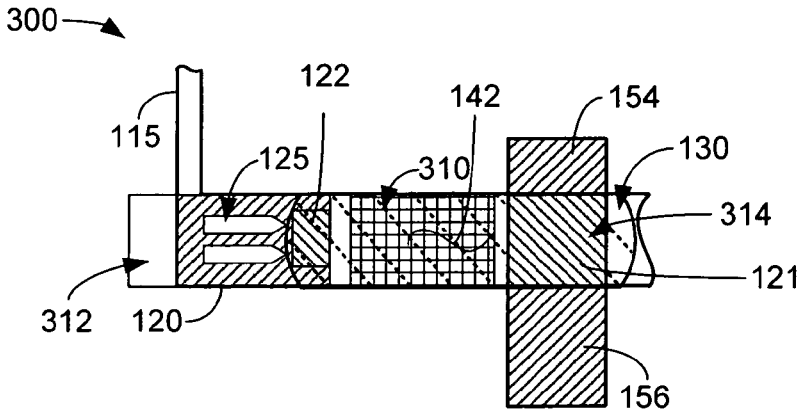
FIG. 3 is a schematic diagram illustrating a portion of the main channel of FIG. 1A.

FIG. 3 is a schematic diagram 300 illustrating a portion of the main channel 120 of FIG. 1A. Much of the second selective dielectric 212 in the channel 120 is omitted from FIG. 3 for clarity. The portion of the main channel 120 includes the feature 125 and also shows the droplet 130. An intermediate wetting region 310 is illustrated approximately as shown in FIG. 3 to assist in preventing the liquid metal droplet 130 from traversing past the output contact 122 and to reposition the droplet 130 over the output contact 122 should the gas pressure cause the droplet 130 to overshoot the output contact 122. A similar intermediate wetting region would be provided in the vicinity of output contact 124 (FIG. 1A).

The main channel 120 also includes a non-wetting region 312 (the second selective dielectric layer 212) to further prevent the droplet 130 from entering non-wetting region 312 of the main channel 120. The main channel 120 also includes a wetting region 314 (i.e., the input contact 121 of FIG. 1A). Although omitted for clarity, the surface of the cap 140 that contacts the droplet 130 may have a wetting pattern similar to the wetting pattern on the surface 142.

Examples of features that define a wetting pattern and influence the contact angle formed by the droplet 130 with respect to the surface 142 include the type of material that covers the surface 142, the patterning of a wetting material formed over a non-wetting surface, and microtexturing to alter the wettability of portions of the surface 142, etc.

Figure 4A:
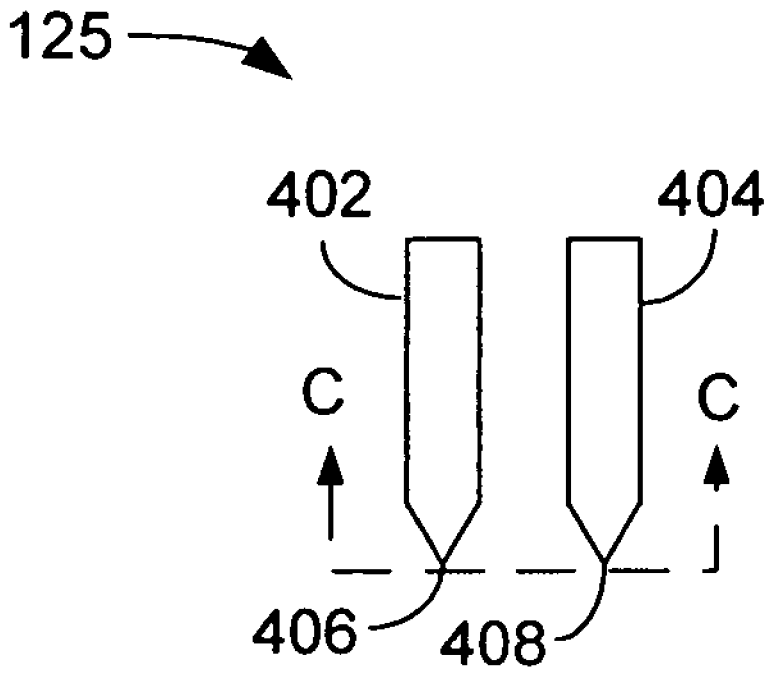
FIG. 4A is a plan view illustrating the feature of FIG. 1A.

FIG. 4A is a plan view illustrating the feature 125 of FIG. 1A. The feature 125 includes sub-feature 402 and sub-feature 404. The sub-features 402 and 404 can be formed in the main channel 120 (FIG. 1A) approximately as shown. The sub-feature 402 includes a point 406 and the sub-feature 404 includes a point 408. The points 406 and 408 are designed to provide minimal contact with the droplet 130 (FIG. 1A).

Figure 4B:
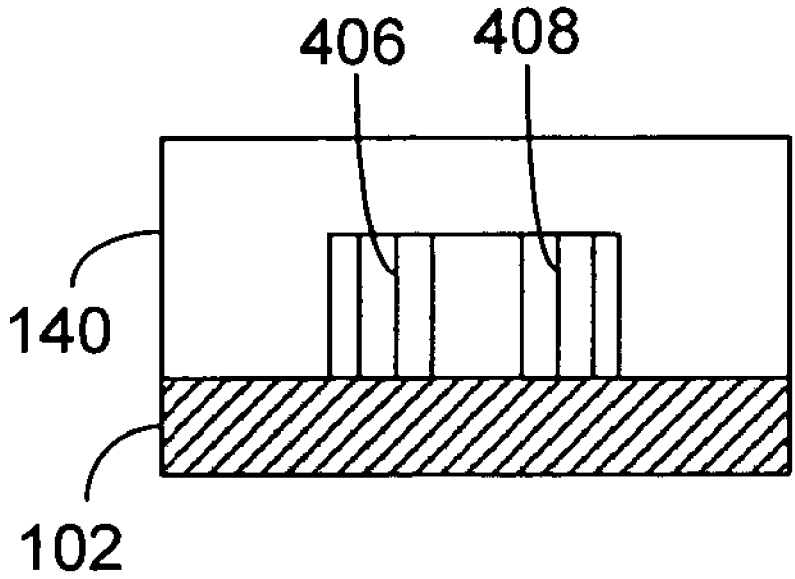
FIG. 4B is a schematic diagram illustrating the feature in FIG. 4A.

FIG. 4B is a schematic diagram illustrating the feature 125 in FIG. 4A. In FIG. 4B, the feature 125 is shown residing over the substrate 102 and under the cap 140. The points 406 and 408 illustrate the portions of the feature 125 that would come into contact with the liquid metal droplet 130 as the liquid metal droplet 130 crosses either the RF output contact 122 or the RF output contact 124. The pointed shape of the feature 125 would make it easy for the liquid metal droplet 130 to de-wet therefrom when gas pressure influences the liquid metal droplet 130 to translate in the direction away from the points 406 and 408. The feature 125 can also be coated with a substance that alters the contact angle between the droplet 130 and the feature 125. The feature 126 is similar to the feature 125.

This disclosure describes illustrative embodiments in accordance with the invention in detail. However, it is to be understood that the invention defined by the appended claims is not limited by the embodiments described.

I claim:

1. A switch, comprising:

an input contact and at least one output contact defined in a channel;

a single droplet of conductive liquid located in the channel, the droplet being in constant contact with the input contact;

a heater configured to heat a gas, the heated gas expanding to cause the droplet to translate through the channel;

a cap portion over the channel; and a gasket configured to seal the channel and the cap portion, in which the channel comprises at least one definable wetting feature configured to position the droplet of conductive liquid.

2. The switch of claim 1, in which the channel comprises at least one definable wetting feature configured to position the droplet of conductive liquid.

3. The switch of claim 2, in which the definable wetting feature comprises a wetting material applied over a non-wetting surface of the channel.

4. The switch of claim 2, in which the definable wetting feature comprises microtexturing applied over a non-wetting surface of the channel.

5. The switch of claim 2, in which a surface of the cap portion that is in contact with the droplet includes the definable wetting feature.

6. A method for making a switch, comprising:

providing a substrate;

defining a channel on the surface of the substrate, providing a single droplet of conductive liquid in the channel;

providing an input contact in the channel and configured such that the input contact is in constant electrical contact with the droplet;

providing a heating means configured to heat a gas, the heated gas expanding to cause the droplet to translate through the channel;

providing a cap portion over the channel;

providing a gasket configured to seal the channel and the cap portion; and providing in the channel at least one feature configured to determine the at-rest position the droplet of conductive liquid.

7. The method of claim 6, further comprising providing in the channel at least one definable wetting feature configured to position the droplet of conductive liquid.

8. The method of claim 7, further comprising defining the wetting feature by applying a wetting material over a non-wetting surface of the channel.

9. The method of claim 7, further comprising defining the wetting feature by microtexturing a non-wetting surface of the channel.

10. The method of claim 7, in which a surface of the cap portion that is in contact with the droplet includes the definable wetting feature.

11. A switch, comprising:

an input contact and at least one output contact defined in a channel;

a single droplet of conductive liquid located in the channel, the droplet being in constant contact with the input contact;

a heater configured to heat a gas, the heated gas expanding to cause the droplet to translate through the channel;

a cap portion over the channel; and a gasket configured to seal the channel and the cap portion in which the channel comprises at least one feature configured to determine the at-rest position of the droplet of conductive liquid and in which the channel comprises at least one definable wetting feature configured to position the droplet of conductive liquid.

12. The switch of claim 11, in which a surface of the cap portion that is in contact with the droplet includes the definable wetting feature.

13. The switch of claim 12, in which the definable wetting feature comprises a wetting material applied over a non-wetting surface of the channel.

14. The switch of claim 12, in which the definable wetting feature comprises microtexturing applied over a non-wetting surface of the channel.

15. The switch of claim 11, in which the at least one feature configured to determine the at-rest position of the droplet is formed on a surface of the channel.

16. The switch of claim 11, in which the at least one feature configured to determine the at-rest position of the droplet is formed on a surface of the cap portion.

* * * * *